United States Patent [19]

Ross et al.

[11] 4,143,236

[45] Mar. 6, 1979

[54] CONTROLLED IMPEDANCE CABLE

[75] Inventors: Edgar A. Ross; Odes D. Tatum, both of Greenville, S.C.

[73] Assignee: Southern Weaving Company, Greenville, S.C.

[21] Appl. No.: 745,249

[22] Filed: Nov. 26, 1976

[51] Int. Cl.[2] ..... H01B 7/08; H01B 11/04

[52] U.S. Cl. ..... 174/32; 174/117 F; 174/117 M

[58] Field of Search ..... 174/32, 117 F, 117 M, 174/34, 115

[56] References Cited

U.S. PATENT DOCUMENTS

| | | | |
|---|---|---|---|
| 3,414,666 | 12/1968 | Doundoulakis | 174/117 M |
| 3,447,120 | 5/1969 | Rask et al. | 339/143 R |
| 3,634,782 | 1/1972 | Marshall | 174/117 F |
| 3,663,739 | 5/1972 | Cherrier | 174/117 F |
| 3,833,755 | 9/1974 | Soelberg | 174/117 F |
| 3,878,103 | 4/1975 | Miller et al. | 174/117 M |

OTHER PUBLICATIONS

Insulation/Circuits, Magazine Article, Aug. 1973, John T. Kolias, author, "How FEP and Flame Retardant PE Flat Cable Insulations Compare".

*Primary Examiner*—Laramie E. Askin
*Assistant Examiner*—E. F. Borchelt
*Attorney, Agent, or Firm*—Bailey, Dority & Flint

[57] ABSTRACT

A woven electrical cable comprising a plurality of longitudinal conductor wires arranged in a substantially side-by-side manner for transmitting signals with a pair of longitudinal ground wires carried between adjacent conductor wires longitudinally coextending in a substantially parallel relationship with said conductor wires providing an associated ground wire on each side thereof for isolating a respective conductor wire. The conductor wires and ground wires are interwoven with insulating fiber strands to define a woven pattern with the associated ground wires being spaced from each respective conductor wire in the woven pattern so as to isolate and set the impedance of each conductor wire at a desired impedance value whereby the cable impedance may be controlled producing transmission of uniform signals with reduced cross-talk interference.

10 Claims, 5 Drawing Figures

CONTROLLED IMPEDANCE CABLE

BACKGROUND OF THE INVENTION

This invention relates to electrical transmission lines and more particularly to woven cables having a plurality of conductors for use in transmitting high frequency electrical signals. Multiconductor transmission cables are commonly used such as in the connection of peripheral equipment to a central computer complex for transmitting input and output data signals.

Use of high frequency transmission cables in sophisticated information and communication systems necessitates that the characteristic impedance of the cable be accurately controlled. Unmatched impedances can result in signal errors which represent erroneous data in the system. Another problem commonly had in high frequency multi-conductor cables is the occurrence of cross-talk interference between adjacent signals owing to the close proximity and sensitivity of the wires in a side-by-side pattern. Quite often a cross-talk interference signal of two to four percent of the signal line voltage can be induced in an adjacent signal line which may falsely trigger a logic circuit.

Various multiconductor cable configurations are known. These can be broadly classified into a first group comprising a plurality of substantially parallel conductor wires embedded in a dielectric material such as shown in United States Letters Pat. No. 3,818,117 and a second group wherein a plurality of conductor wires are arranged in a side-by-side relationship and interwoven with insulating fiber strands to form a woven cable such as shown in United States Letters Pat. No. 3,447,120. Both of these patents utilize the concept of a "shared" ground line or wire wherein adjacent signal wires share a common ground wire therebetween.

The characteristic impedance of such a cable is controlled by the geometrical configuration of the signal and ground wire relationship. Likewise, cross-talk may be controlled by spacing between the signal wires. In the case of a woven cable, the "shared" ground wire concept requires that the signal and ground wires have substantially equilateral or symmetrical spacing therebetween for matched impedance. If the spacing between signal wires is altered to reduce cross-talk interference, the resulting dissymetry between the signal wires and the shared ground wires creates unmatched impedances between signals. Such a concept does not allow for versatility in the geometrical configuration of the cable.

SUMMARY OF THE INVENTION

It has been found that a woven electrical signal transmission cable can be provided having controlled impedance and reduced cross-talk interference comprising a plurality of longitudinal conductor wires arranged in a side-by-side manner for transmitting signals, and a pair of longitudinal ground wires carried between adjacent conductor wires longitudinally coextending in a substantially parallel relationship with the conductor wires providing an independently associated ground wire on each side thereof isolating each respective conductor. The conductor wires and ground wires are interwoven with insulating fiber strands to define a woven pattern. The associated ground wires are spaced from each respective conductor wire in the woven pattern so as to set the impedance of the conductor wire at a desired impedance value. Thus, the impedance of each conductor wire may be matched with variable spacing between signal wires producing a transmission cable having a controlled impedance and reduced cross-talk interference for transmitting uniform signals.

Accordingly, an important object of the present invention is to provide a woven high-frequency transmission cable having reduced cross-talk interference and a controlled impedance providing uniform signal propagation.

Another important object of the present invention is to provide a woven high-frequency transmission cable wherein the signal and ground wires may be accurately spaced during design and manufacturing to provide a desired cable impedance.

Still another important object of the present invention is to provide a woven transmission cable including longitudinal signal and conductor wires interwoven with warp and filling strands wherein double ground wires are woven between adjacent signal wires to effectively isolate each signal.

Still another important object of the present invention is to provide a woven transmission cable wherein each signal wire is isolated by an independently associated ground wire on each side thereof so that the spacing of the signal wires may be varied without altering the characteristic impedance of the cable.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
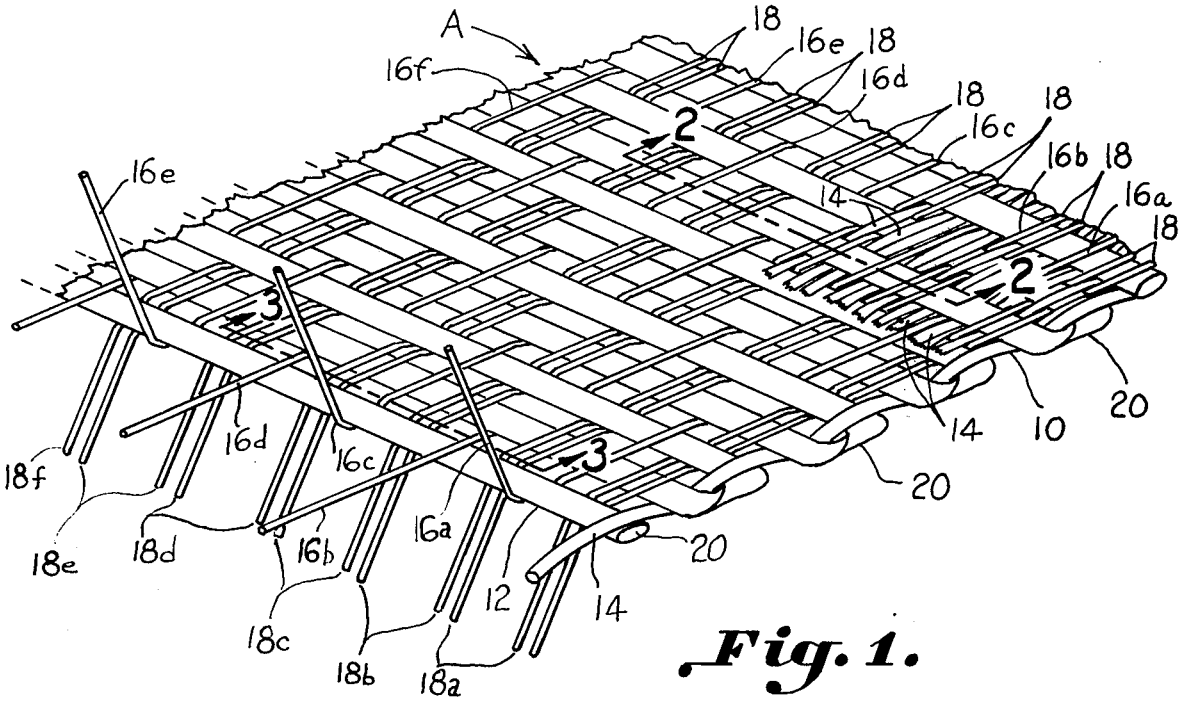
FIG. 1 is a perspective view partially cut away illustrating a woven transmission cable having controlled impedance as constructed in accordance with the present invention.

Referring now in detail to FIG. 1, a woven transmission cable having a controlled impedance is indicated generally at A. FIG. 1 is a partially cut away view of a controlled impedance cable A constructed in accordance with the present invention as illustrating only what is necessary for an understanding of the invention wherein only a portion of a finished right hand selvage 10 and a finished forward end 12 of the cable are illustrated. It being understood, of course, that the remaining edges of the cable that are broken away may be finished in a like manner. Also, only a few longitudinal runs of the fiber warp strands 14 are illustrated with the remainder being omitted for purposes of clarity.

The woven transmission cable A has a construction proving particularly advantageous in the transmission of high frequency signals such as input and output signals to a central computer complex. The woven cable A comprises a plurality of longitudinal conductor wires numbered consecutively from the right hand selvage 10 as 16*a* through 16*f*. The conductors 16*a*–16*f* are arranged in a substantially side-by-side relationship for transmitting the high frequency electrical signals. A pair of longitudinal ground wires 18 are carried between adjacent conductor wires in the woven cable. The ground wires 18 longitudinally co-extend in a substantially parallel relationship with the conductor or signal wires 16*a* through 16*f*. Thus, an independently associated ground wire 18 is provided on each side of each respective conductor wire 16 to isolate each conductor wire from spurious signals and the like. For example, considering the geometrical configuration illustrated in FIG. 3, conductor wire 16*c* has an independently associated ground wire 18*c* laterally spaced in the woven cable adjacent each side thereof. The ground wires 18*c* provide a ground exclusively for the conductor 16*c* as the adjacent conductors, 16*d* and 16*b*, are provided with their own independently associated ground wire pairs 18*d* and 18*b*, respectively.

The conductor wires 16 and the conductor wires 18 are interwoven with the insulating fiber warp strand 14 and a insulating fiber fill strand 20 which define a woven pattern having a substantially flat configuration. The warp strand 14 and the fill strand 20 are shown only schematically for the sake of clarity and preferably consist of an aromatic polyamide material such as a plurality of extremely fine Nomex nylon strands. The aromatic polyamide material has the necessary fire-retardant properties and is a factor in the dielectric constant for obtaining the desired impedance value. In the woven pattern, the lateral spacing between the exclusive ground wire pairs and their respective conductor may be predetermined. The predetermined lateral spacing between the wires fixes the impedance of each conductor wire 16 at a desired value whereby the cable impedance can be accurately controlled. After the woven pattern of the transmission cable is formed by conventional weaving methods, a coating of a suitable polymeric material, such as polyurethane, may be applied to the woven cable to further set the geometrical configuration of the cable and maintain the matched impedance of the cable.

The cable A is preferably woven by conventional loom programming such that conductor wires 16 have an undulating shape along the length of the cable. In particular, adjacent conductor wires, such as 16*c* and 16*d*, are aligned in the woven cable with their respective undulations being approximately one hundred and eighty degrees out of phase.

Figure 2:
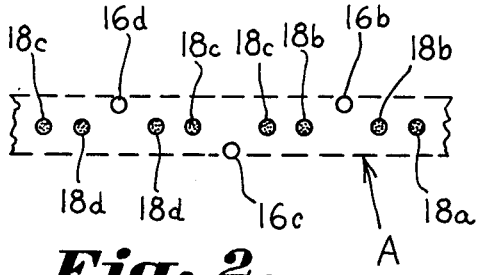
FIG. 2 is a schematic diagram illustrating the geometrical configuration of the conductor and ground wires of a controlled impedance cable constructed in accordance with the present invention as taken along line 2—2 of FIG. 1.
Figure 3:
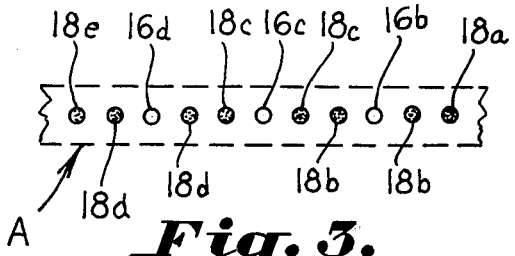
FIG. 3 is a schematic diagram illustrating the geometrical configuration of the ground and conductor wires of a controlled impedance cable constructed in accordance with the present invention taken along line 3—3 of FIG. 1.

The FIGS. 2 and 3 illustrate the relationships of the signal and ground wire undulations when in two different phases as taken along lines 2—2 and 3—3 of FIG. 1. In FIG. 2, the signal wire undulations have their maximum vertical separation while in FIG. 3, the wires are all in the same horizontal plane.

Figure 4:
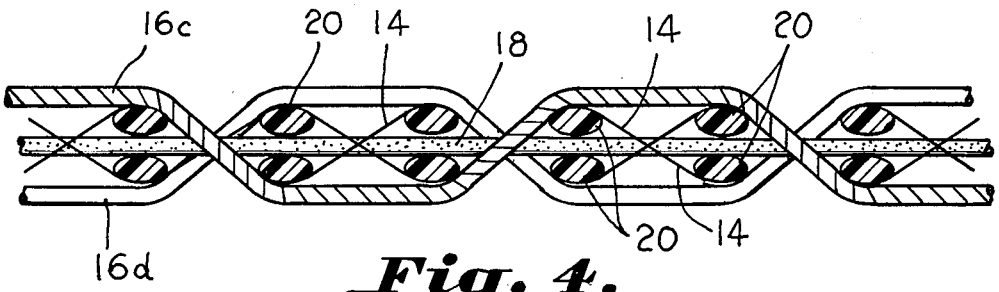
FIG. 4 is a side elevational view illustrating a woven transmission cable constructed in accordance with the present invention having a woven pattern formed by weaving on a cross-shot weaving loom.
Figure 5:
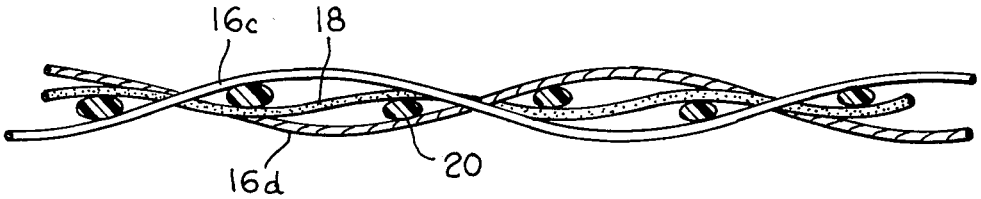
FIG. 5 is a side elevational view illustrating a woven transmission cable constructed in accordance with the present invention having a woven pattern formed by weaving on a conventional loom.

FIGS. 4 and 5 illustrate the undulations of adjacent conductor wires 16*c* and 16*d* for two different weaving patterns. FIG. 4 illustrates the undulations of conductor wires 16*c* and 16*d* when woven on a conventional cross-shot loom. FIG. 5 illustrates the undulations of conductor wires 16*c* and 16*d* when woven on a standard conventional loom. In either case, the undulations are effective for reducing cross-talk between adjacent conductor wires which often occurs owing to the close proximity of the adjacent conductor wires in the transmission cable. For example, woven transmission cables having an impedance of 75 ohms and as little as twenty-five mil spacing between the centers of the signal wires have been constructed with 34 gauge wiring.

When the cable A is woven on a cross-shot loom with the conductor wire undulating as illustrated in FIG. 4, the ground wires 18 extend substantially in a straight line through the woven cable approximately through the vertical middle of the conductor wire undulations. When the cable A is woven on a standard loom having the undulations as illustrated in FIG. 5, the ground wires 18 have an undulating shape with an amplitude of approximately one-half that of the undulations of the conductor wires 16*c* and 16*d*.

The controlled impedance cable A has particular advantages when used in logic circuits having a quiet line. The quiet lines are necessarily kept at a zero signal level in order to trigger certain logic circuits. It is important in such a circuit not to induce spurious signals in the quiet lines due to cross-talk from adjacent conductor wires which are carrying signals. It becomes desirable in many instances to space the quiet lines as far from the signal lines as possible in order to reduce any cross-talk. However, such a dissymmetry between the center spacing of the wires can result in unbalanced or unmatched impedances for the wires in a "shared" ground cable. The cable A constructed in accordance with the "isolated" ground concept in accordance with the present invention provides isolation of the wires by the exclusive ground wires on each side thereof even with variable lateral spacing of the signal wires. Thus, the impedance of the signal wires is matched and the cable impedance controlled with reduced cross-talk. Other situations may arise where it is desirable to provide unsymmetrical spacing between the signals such as for reducing normal cross-talk between adjacent signals while controlling the cable impedance.

The cable impedance of a woven high frequency transmission cable such as shown in FIG. 1 generally depends on the geometric configuration of the signal and ground wires and the dielectric constant. In a preferred form of the woven transmission cable A, the dielectric is a compound dielectric constant including the air around the cable, the Nomex strands of insulating fibers 14 and 20, the polyurethane insulation surrounding each individual signal wire, a nylon jacket normally surrounding the polyurethane insulation of each wire to prevent abrasion, and finally the polyurethane coating sprayed over the cable to give it stability and further fix the geometric configuration of the wires in the woven pattern. In one embodiment of the "double" or "isolated" ground cable A, forty-eight individual signal wires 16 are utilized with a total of one hundred and two ground wires 18 providing exclusive ground wires on each side of each signal wire. Extra ground wires may be used at the selvages. Normally, the impedance of such cable assemblies must be maintained within a plus or minus five percent tolerance.

The compound dielectric constant can be predicted and determined from previous experience with sufficient accuracy so that the desired impedance value may be achieved by altering the geometrical configuration only. For this purpose, the "double or isolated" ground configuration of the present invention is particularly expedient. The exclusive grounds on each side of a signal wire may be moved closer to or further away from the signal wire in order to achieve the desired impedance. The impedance of the adjacent signal wire is unaffected by the movement of the ground wires exclusively associated with another signal wire.

Another advantage of a transmission cable constructed in accordance with the present invention is that it is relatively easy to connect to terminals. When the woven pattern described above is produced on programmed looms, the wires 16 and 18 may be "floated" at spaced intervals along the length of the woven cable during manufacture. Floating of the wires brings the wires up out of the insulating fiber strands 14 and 20 onto the upper surface of the cable for a distance and then brings them back into the woven pattern together with the woven fill strands. This enables the user of the transmission cable to simply cut the fabric at the portion where the wires have been floated whereupon the wires can be broken out of the cable in various planes. For example, in FIG. 1, the ground wires 18*a* through 18*f* are broken out of the transmission cable in a downwardly inclined plane while the signal wires 16*d*, 16*f* are broken out in a horizontal plane with the remaining signal wires being terminated in an upwardly inclined plane. When considering the extremely large number of wires included in such a cable, this manner of termination is highly advantageous for accurate programmed connection to conventional terminal connectors.

While a preferred embodiment of the invention has been described using specific terms, such description is for illustrative purposes only, and it is to be understood that changes and variations may be made without departing from the spirit or scope of the following claims.

What is claimed is:

1. A woven electrical transmission cable for transmitting high-frequency signals having a controlled impedance comprising:

a plurality of longitudinal conductor wires arranged in a substantially side-by-side relationship for transmitting said signals;

a pair of longitudinal ground wires carried between next adjacent conductor wires longitudinally coextending in a substantially parallel relationship with said conductor wires providing an independently associated ground wire on each said of each respective conductor wire to isolate each said conductor wire;

said conductor wires and ground wires interwoven with insulating fiber strands defining a woven pattern;

said woven pattern including said insulating fiber strands woven in the warp and filling directions; said conductor wires being woven in said woven pattern so as to have an undulating shape; and said associated ground wires being spaced from each respective conductor wire in said woven pattern so as to isolate and fix the impedance of each said conductor wire at a desired impedance value;

whereby the impedance of each conductor wire may be matched regardless of conductor wire symmetry for producing transmission of uniform signals with reduced cross-talk interference.

2. The structure of claim 1 wherein said woven transmission cable is coated with a polymeric material further fixing the desired spacing of said ground and conductor wires relative to one another in said woven pattern while adding to the total dielectric constant to obtain the desired impedance value.

3. The structure of claim 1 wherein said conductor wires have an undulating shape being aligned in said cable with the undulations of adjacent conductor wires being approximately 180 degrees out of phase.

4. The structure of claim 3 wherein said ground wires have an undulating shape with an amplitude of approximately one-half that of said conductor wire undulations.

5. The structure of claim 3 wherein said ground wires extend substantially in a straight line through said cable approximately through the vertical middle of said conductor wire undulations.

6. A woven electrical transmission cable for transmitting high-frequency signals having controlled impedance and reduced cross-talk interference comprising:

a plurality of longitudinal conductors arranged in a substantially side-by-side configuration for transmitting said signals;

an exclusive ground wire laterally spaced next adjacent each side of each said conductor defining an exclusive ground pair for isolating each said conductor;

said conductors and ground wires being interwoven with fiber warp and filling strands defining a woven pattern therewith, said conductors being woven in an undulating manner in said woven pattern;

said lateral spacing between each said exclusive ground wire and a respective conductor being predetermined in said woven pattern so as to fix the impedance of said conductor at a desired value; and said conductor wires being effectively isolated by said pair of exclusive ground wires so as to permit alteration and variation in the spacing between conductor wires to reduce cross-talk interference without changing said desired impedance value;

whereby the impedance of each conductor may be matched producing a transmission cable having a controlled impedance and reduced cross-talk interference for transmitting uniform signals.

7. The structure of claim 6 wherein said conductor wires have an undulating shape being aligned in said cable with the undulations of adjacent conductor wires being approximately 180 degrees out of phase.

8. The structure of claim 7 wherein said ground wires have an undulating shape with an amplitude of less than that of said conductor wire undulations.

9. The structure of claim 7 wherein said ground wires extend substantially in a straight line through said cable approximately through the vertical middle of said conductor wire undulations.

10. The structure of claim 1 wherein said insulating fiber strands include an aromatic polyamide material.

* * * * *